US010004340B1

(12) United States Patent
Guerin

(10) Patent No.: US 10,004,340 B1
(45) Date of Patent: Jun. 26, 2018

(54) BEDDING HOLDER AND ASSOCIATED METHOD OF INSTALLATION

(71) Applicant: Phillip M. Guerin, Lawrence, MA (US)

(72) Inventor: Phillip M. Guerin, Lawrence, MA (US)

( * ) Notice: Subject to any disclaimer, the term of this patent is extended or adjusted under 35 U.S.C. 154(b) by 0 days. days.

(21) Appl. No.: 15/676,465

(22) Filed: Aug. 14, 2017

(51) Int. Cl.
*A47C 21/02* (2006.01)

(52) U.S. Cl.
CPC ..... *A47C 21/022* (2013.01); *A47C 21/028* (2013.01)

(58) Field of Classification Search
CPC ..... A47C 21/02
USPC ..... 5/498, 504.1, 496; 24/72.5
See application file for complete search history.

(56) References Cited

U.S. PATENT DOCUMENTS 3,961,782 A 6/1976 Lowry
4,635,308 A * 1/1987 Maggio ..... A47G 9/0238 24/72.5
4,891,856 A 1/1990 Thornhill
4,967,434 A 11/1990 Hill
5,555,578 A 9/1996 Wyatt et al.
6,457,194 B1 10/2002 Bennett
8,321,975 B1 12/2012 Lindberg et al.
D692,258 S * 10/2013 Patzer ..... D6/607
8,918,931 B1 12/2014 Baker et al.
9,155,401 B1 10/2015 Wergedal
9,591,929 B1 3/2017 Surman

* cited by examiner

*Primary Examiner* — Fredrick C Conley
(74) *Attorney, Agent, or Firm* — David M. Driscoll, Esq.

(57) ABSTRACT

A bedding anchor is in the form of a single holder that has at least one open through port for receiving an edge of a bedding fabric. The single holder is elongated in shape, has a length greater than a width thereof, and has the one open port arranged closer to one end of opposed one and other ends of the single holder so that, when the single holder is flipped lengthwise, the single holder can be inserted under an overlying supporting mattress. The holder includes at least a first through port disposed adjacent the one end of the holder, and at least a second through port disposed adjacent the other end of the holder with the at least one first through port being larger in open area than the at least one second port.

21 Claims, 24 Drawing Sheets

BEDDING HOLDER AND ASSOCIATED METHOD OF INSTALLATION

FIELD OF THE INVENTION

The present invention relates in general to a bedding holder that enables the securing of bedding, such as sheets or blankets to a mattress or the like. More particularly, the present invention relates to a bedding holder that enables the securing of bedding, such as sheets or blankets in a simple and effective manner, and preferably at corners of the support surface over which the bedding is secured. The present invention also relates to a bedding holder that enables the securing of bedding, such as sheets or blankets to a mattress or the like and that is provided with means by which the holder can readily accept either thinner bedding such as sheets or thicker bedding such as a blanket or comforter. The present invention also relates to a method of using a bedding anchor for securing corners of a bedding fabric relative to a mattress over which the bedding fabric is to be secured.

BACKGROUND OF THE INVENTION

There presently does exist various forms of bed linen holders. Refer, for example, to U.S. Pat. No. 4,967,434 to Hill and U.S. Pat. No. 6,457,194 to Bennett. There are a number of drawbacks to existing holders such as the fact that they do not provide a sufficient surface area to hold the bedding; they are complex in their construction and they do not readily accommodate different types of bedding such as linen sheets, blankets and comforters.

Accordingly, it is an object of the present invention to provide an improved bedding holder that enables the securing of bedding, such as sheets or blankets to a mattress or the like.

Another object of the present invention is to provide a bedding holder that enables the securing of bedding, such as sheets or blankets in a simple and effective manner, and preferably at corners of the support surface over which the bedding is secured.

Still another object of the present invention is to provide a bedding holder that enables the securing of bedding, such as sheets or blankets to a mattress or the like and that is provided with means by which the holder can readily accept either thinner bedding such as sheets or thicker bedding such as a blanket or comforter.

A further object of the present invention is to provide a method of using a bedding anchor for securing corners of a bedding fabric relative to a mattress over which the bedding fabric is to be secured.

SUMMARY OF THE INVENTION

To accomplish the foregoing and other objects, features and advantages of the present invention there is provided a bedding anchor that is comprised of a single holder that has at least one open through port for receiving an edge of a bedding fabric therethrough. The single holder is elongated in shape, has a length greater than a width thereof, and has the one open port arranged closer to one end of opposed one and other ends of the single holder so that, when the single holder is flipped lengthwise, the single holder can be inserted under an overlying supporting mattress.

In accordance with other aspects of the present invention the single holder is substantially planar has one and other opposed flat surfaces; the elongated holder has a length that is at least three times the width of the elongated holder; the open through port has an enlarged portion that is contiguous with a slotted portion; the single holder has a pair of spaced apart open through ports for receiving the bedding fabric; the at least one open through port has a living hinge for support of a hinged piece; the single holder has a pair of open through ports disposed respectively at the one and other ends of the single holder; one of the pair of open through ports is larger in area than the other of the pair of open through ports; the pair of open through ports are separated from each other with one of the open through ports being closer to the one end of the holder and the other open through port being closer to the other end of the holder; each open through port has an enlarged portion that is contiguous with a slotted portion; at least the slotted portions of respective open through ports are of different width; each open through port is comprised of a living hinge for support of a hinged piece; and the single holder is substantially planar having one and other opposed flat surfaces that are of different visual characteristics.

Also, in accordance with the present invention there is provided a method of using a bedding anchor for securing corners of a bedding fabric relative to a mattress over which the bedding fabric is to be secured. The steps of the method include providing a holder that has at least one open through port for receiving an edge of a bedding fabric therethrough with holder being elongated in shape, having a length greater than a width thereof, and having the one open port arranged closer to one end of opposed one and other ends of the holder, inserting the bedding fabric through the open through port so that the bedding fabric interlocks with the open through port, pivoting the holder lengthwise and inserting the pivoted holder under the overlying mattress.

In accordance with other aspects of the present invention the bedding fabric can be initially inserted either downwardly or upwardly relative to the holder open through port; the open through port has an enlarged portion that is contiguous with a slotted portion and the step of inserting includes inserting first through the enlarged portion and subsequently moving the bedding fabric into the slotted portion; the holder includes a pair of open through ports disposed respectively at the one and other ends of the holder; one of the pair of open through ports is larger in area than the other of the pair of open through ports; the open through ports are comprised of one of a set of two open through ports, a single open through port having an enlarged portion that is contiguous with a slotted portion and an open through port having a living hinge; and the holder includes at least a first through port disposed adjacent the one end of the holder, and at least a second through port disposed adjacent the other end of the holder, said at least one first through port being larger in open area than the at least one second port.

BRIEF DESCRIPTION OF THE DRAWINGS

It should be understood that the drawings are provided for the purpose of illustration only and are not intended to define the limits of the disclosure. In the drawings depicting the present invention, all dimensions are to scale. The foregoing and other objects and advantages of the embodiments described herein will become apparent with reference to the following detailed description when taken in conjunction with the accompanying drawings in which.

DETAILED DESCRIPTION

The present invention is in the form of a bedding anchor that is comprised of a single holder that has at least one open through port for receiving an edge of a bedding fabric therethrough. In this regard refer, for example to FIGS. 4-7 that illustrate steps in performing the associated method of installation of the holder of the present invention. As shown in all embodiments described herein the holder is preferably elongated in shape, has a length greater than a width thereof, and has the one open port arranged closer to one end of opposed one and other ends of the single holder so that, when the single holder is flipped lengthwise, the single holder can be inserted under an overlying supporting mattress.

Figure 1:
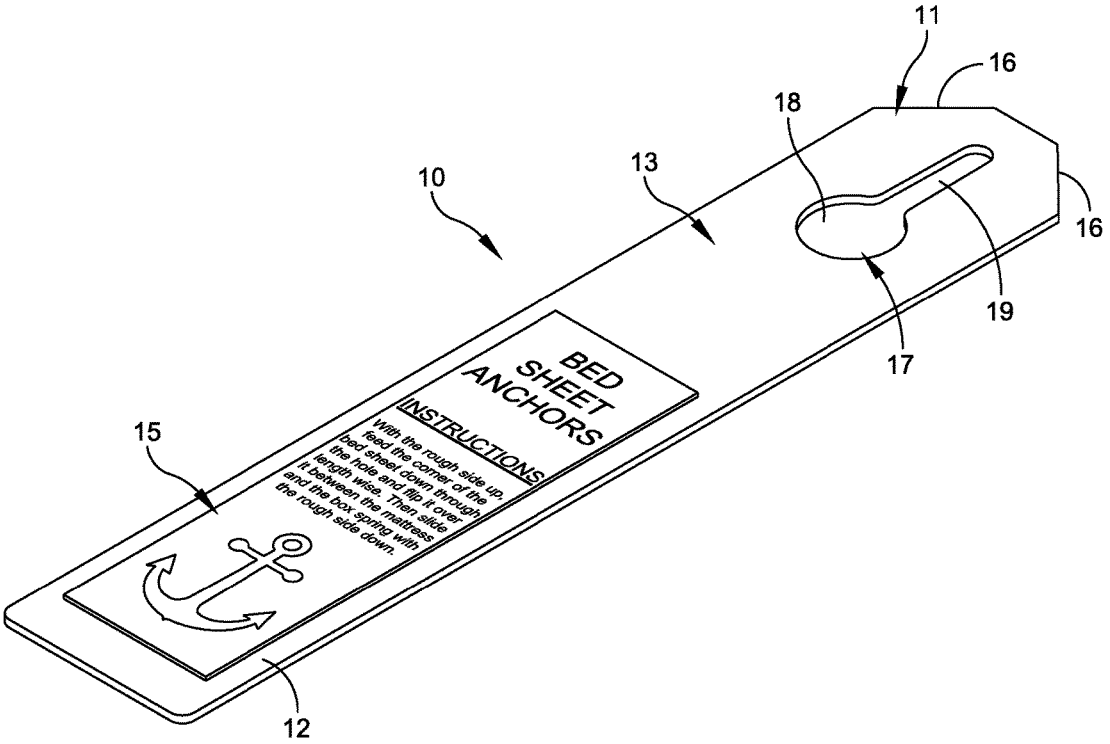
FIG. 1 is a perspective view showing one side of the bedding holder of the present invention.
Figure 2:
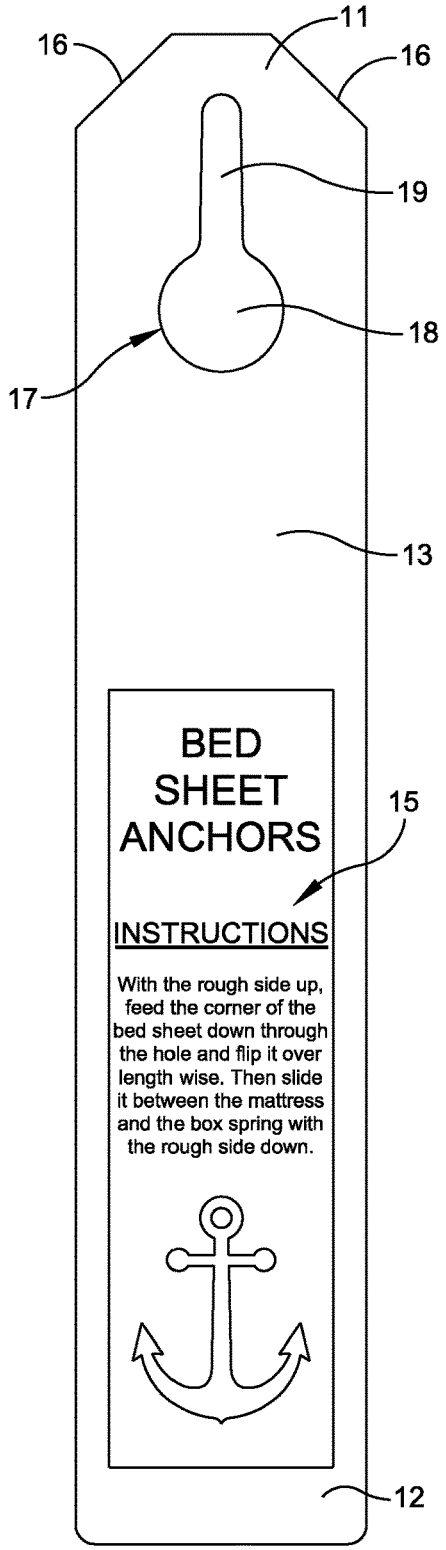
FIG. 2 is a plan view of one side of the bedding holder of FIG. 1.
Figure 3:
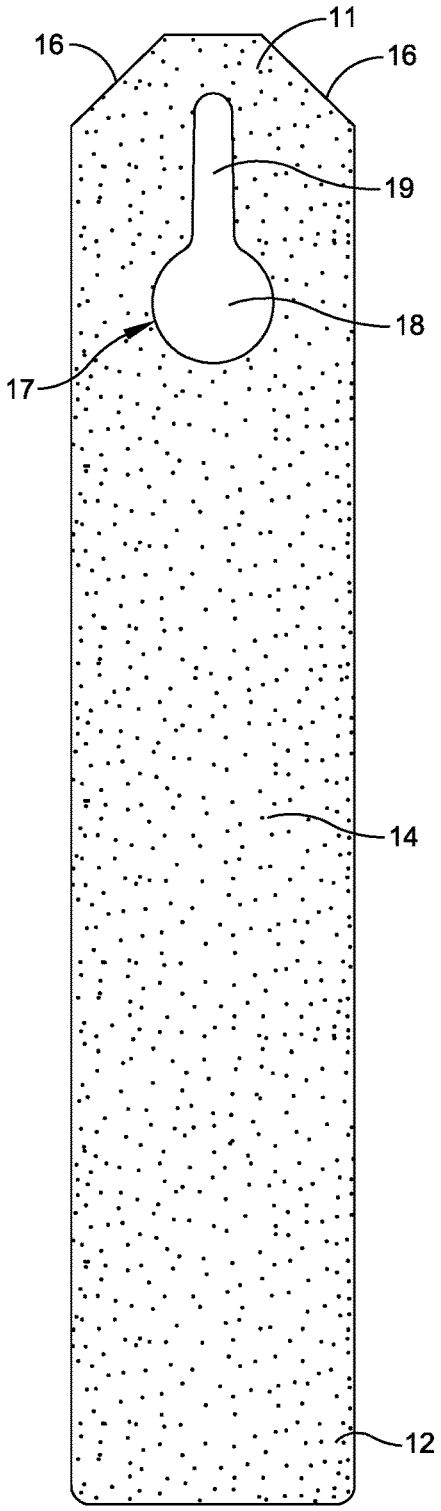
FIG. 3 is a plan view of the other side of the bedding holder of FIG. 1.

A first embodiment of the present invention is illustrated in FIGS. 1-3 including a holder 10 having a one end 11 and an other end 12. As illustrated in the drawings in about all embodiments the holder may be constructed of a relatively thin material that may include, but is not limited to, a plastic material, a fiberglass material, a wood material or various composite materials. The holder is also preferably flat on both sides and relatively thin in construction. The holder 10 is substantially planar and may also be considered as having one and other opposed flat sides or surfaces 13, 14. In FIGS. 1 and 2 the side 13 is shown as having instruction indicia indicated at 15. The instruction indicia 15 may be in the form of a stick-on label and provides a set of instructions for the user, as follows: With the rough side up, feed the corner of the bed sheet down through the hole and flip it over lengthwise. Then slide it between the mattress and the box spring with the rough side down. In connection with the label 15 it is noted that a "rough" side is indicated which is depicted in FIG. 3 at the side or surface 14. The side or surface 13 may be smooth or of other differentiating texture or color may be employed.

Figure 4:
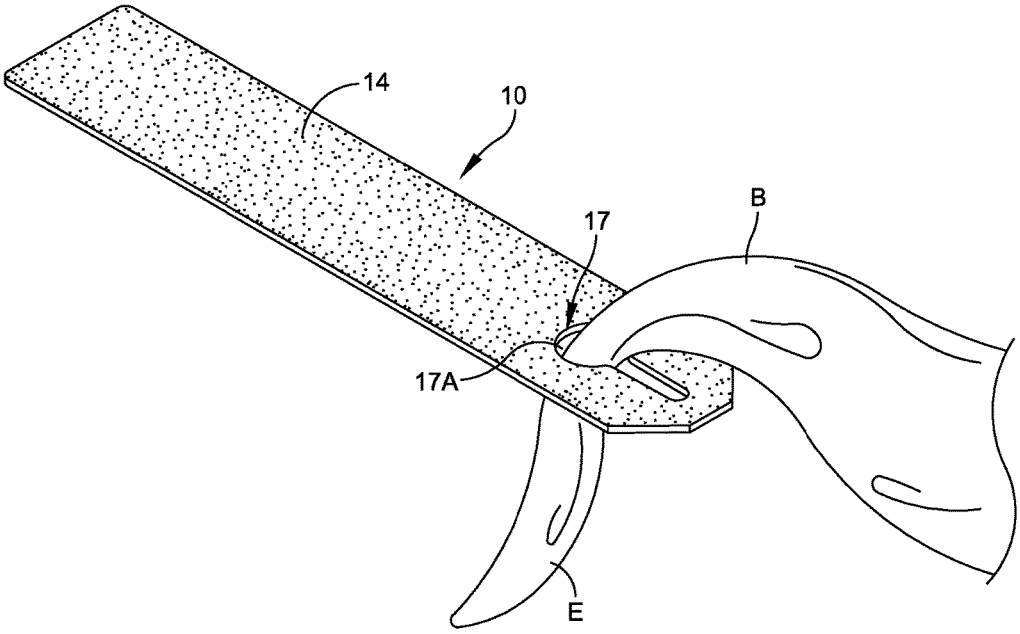
FIG. 4 shows an initial method step in securing the bedding fabric using the holder of the present invention.
Figure 5:
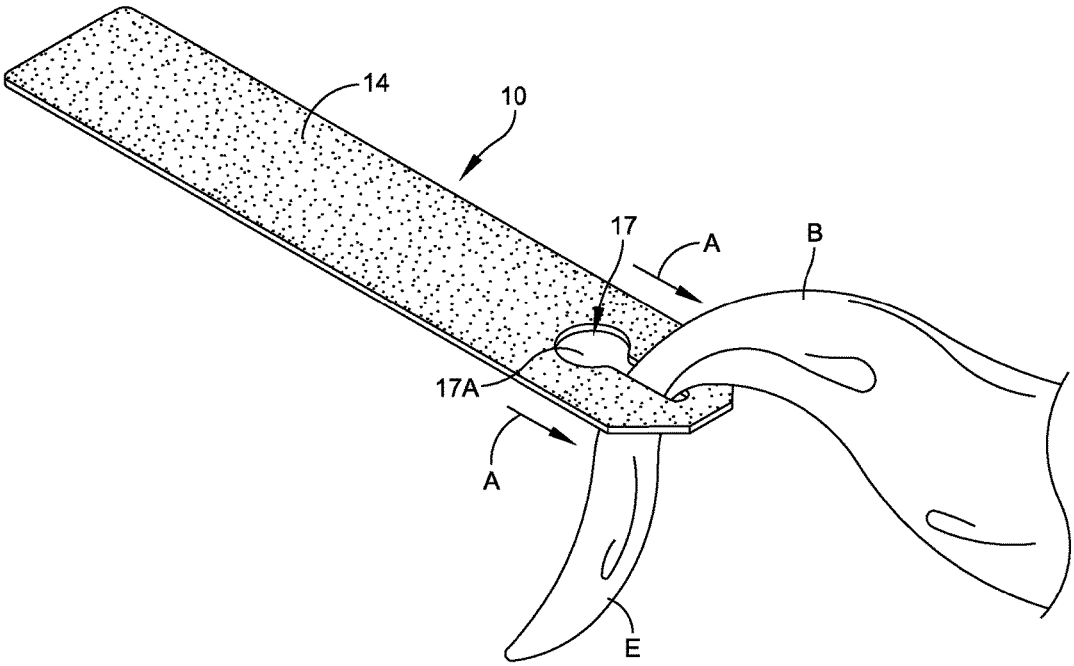
FIG. 5 is a subsequent method step in securing the bedding fabric using the holder of the present invention.
Figure 6:
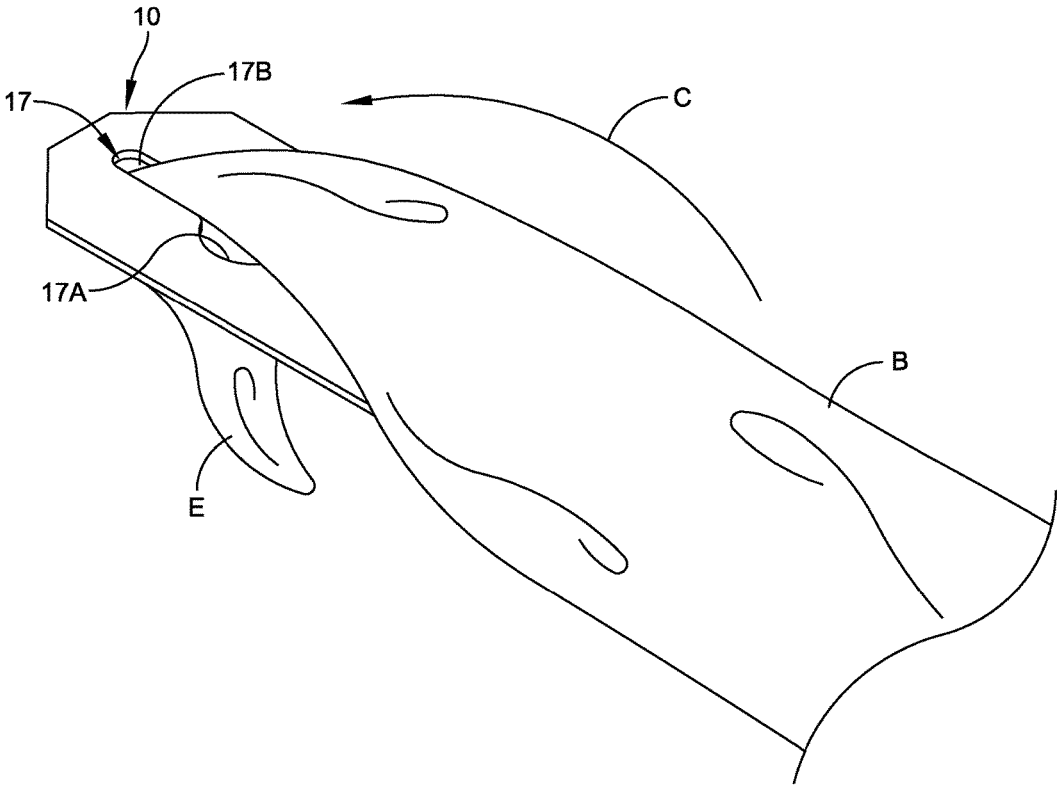
FIG. 6 is a still subsequent method step in securing the bedding fabric using the holder of the present invention.
Figure 7:
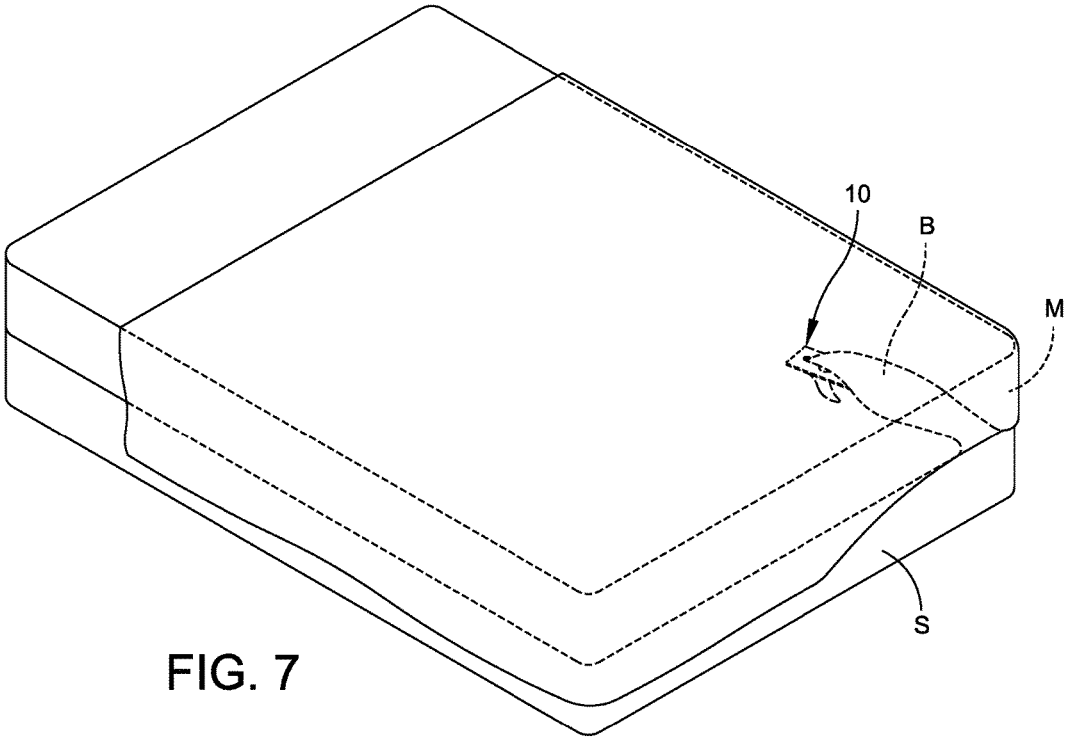
FIG. 7 is a perspective view showing the holder in its final position between the mattress and box spring.
Figure 8:
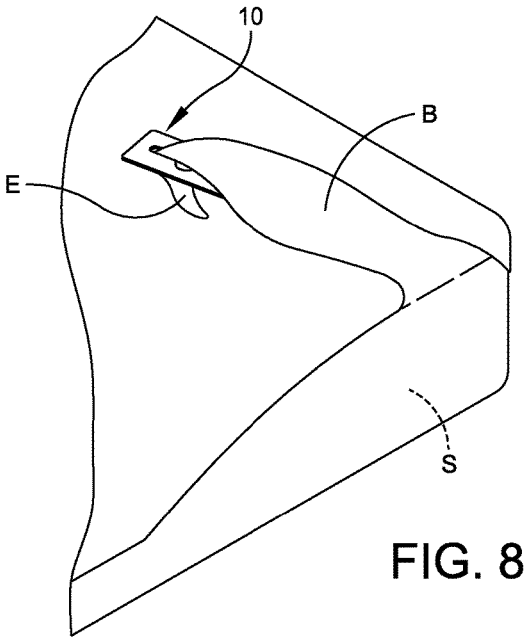
FIG. 8 is an enlarged fragmentary view showing the holder in a final position under the mattress.

The one end of the holder 10 in this embodiment has opposed tapered edges 16 to assist in insertion as in the step shown in FIGS. 6 and 7. FIGS. 1-3 also illustrate the open through port 17 as having an enlarged portion 18 which is shown as substantially circular and a slotted portion 19 that is contiguous with the circular portion. In the following description various methods of installation are described including such steps inserting the bedding corned either upwardly or downwardly; flipping the holder lengthwise or rotating the holder; or positioning the holder with the retaining holes either facing inward or facing outward of the mattress. In connection with the first embodiment described herein in FIGS. 1-3, FIG. 4 shows a first step in the method of securing the bed holder of the present invention. For this purpose, the bed holder has an open hole 17 that includes a circular portion 17A and an elongated slit or slot portion 17B that is contiguous with the circular portion 17A. FIG. 4 shows the edge or corner E of the bedding B being inserted at the circular portion 17A. FIG. 5 illustrates the bedding then moved in the direction of arrows A into the slot portion 17B so as to secure the corner E of the bedding relative to the holder. FIG. 6 then illustrates the next step of rotating the holder lengthwise illustrated by the arrow C in FIG. 6. FIGS. 7 and 8 then illustrate the final position of the holder 10. In this final position, the open port in the holder is faced inwardly thus securing the corner of the sheet or other fabric in a fixed position between the mattress M and the box spring S.

In another embodiment regarding the installation of the bedding material, rather than looping the corner of the sheet downwardly as in FIGS. 4 and 5, one can loop the corner of the sheet upwardly through the single hole. The holder is positioned at the corner of the mattress at substantially a 45 degree angle as viewed from above. The end of the bed sheet anchor is at the corner of the mattress and when the sheet is pulled up over the end of the bed anchor, the anchor is forced against the bottom of the mattress clamping the sheet corner tail between the bed anchor and the mattress. The holder can be kept under the mattress when changing sheets and the sheet tail can simply be inserted from the bottom. The main portion of the sheet will wrap around the end of the bed anchor. In this version the bed anchor will be positioned similar to that shown in FIGS. 7 and 8 at the corner of the mattress or with the hole in the holder facing outwardly.

Figure 9:
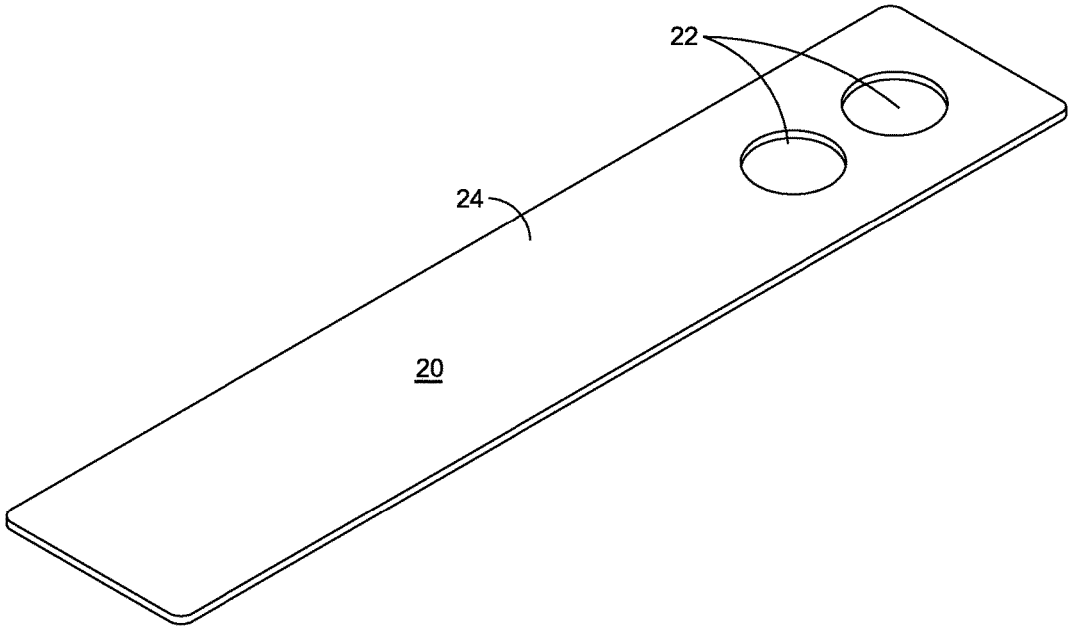
FIG. 9 is a perspective view showing one side of a second embodiment of the bedding holder of the present invention.
Figure 10:
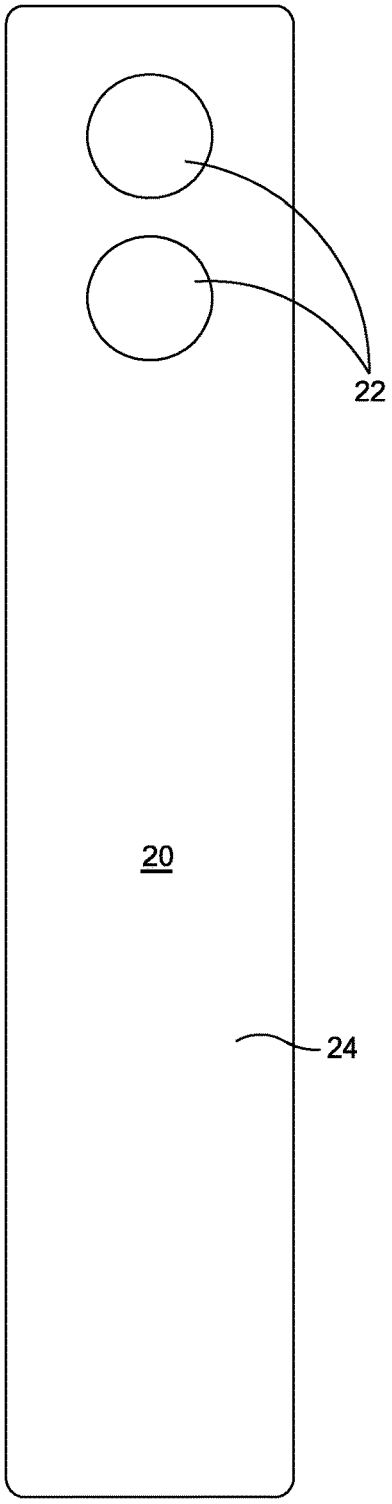
FIG. 10 is a plan view of one side of the bedding holder of FIG. 9.
Figure 11:
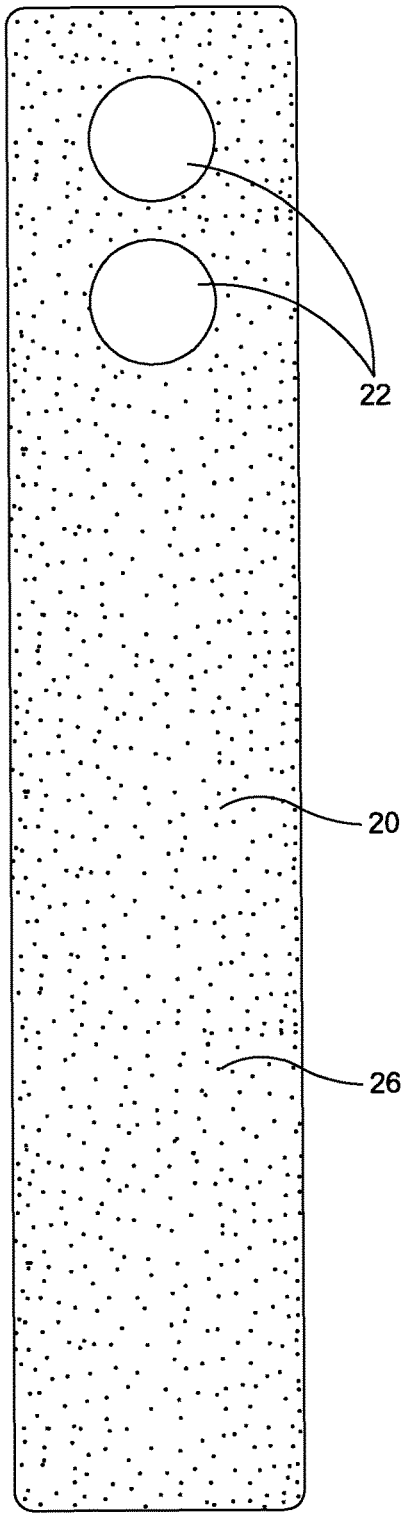
FIG. 11 is a plan view of the other side of the bedding holder of FIG. 10.

Reference is now made to a further embodiment of the present invention illustrated in FIGS. 9-11, in this embodiment there is provided a bed holder 20 that has at one end thereof two circular holes 22. FIGS. 9 and 10 show one side 24 of the relatively thin planar holder and FIG. 11 shows the opposite side 26 of the holder which is illustrated as a roughened surface.

Figure 13:
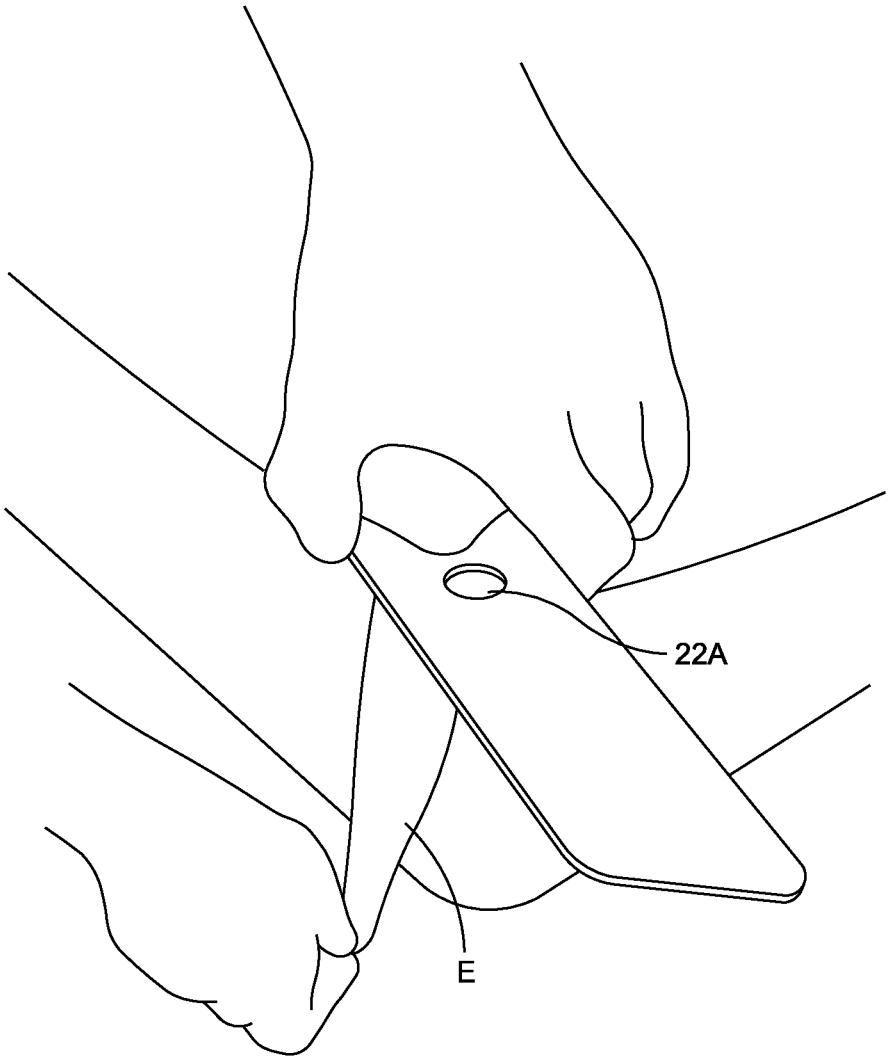
FIG. 13 shows a subsequent step in securing the bedding fabric by pulling the corner through the hole in the holder.
Figure 14:
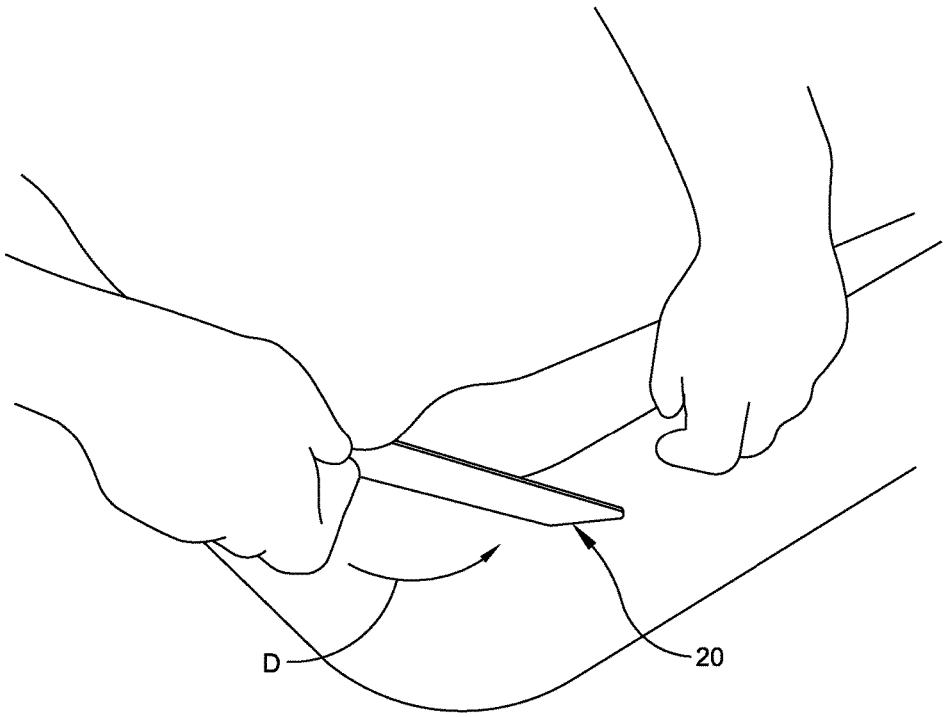
FIG. 14 is a still subsequent method step for this holder showing the holder rotated so that the holes face outwardly and tucked under the mattress.
Figure 15:
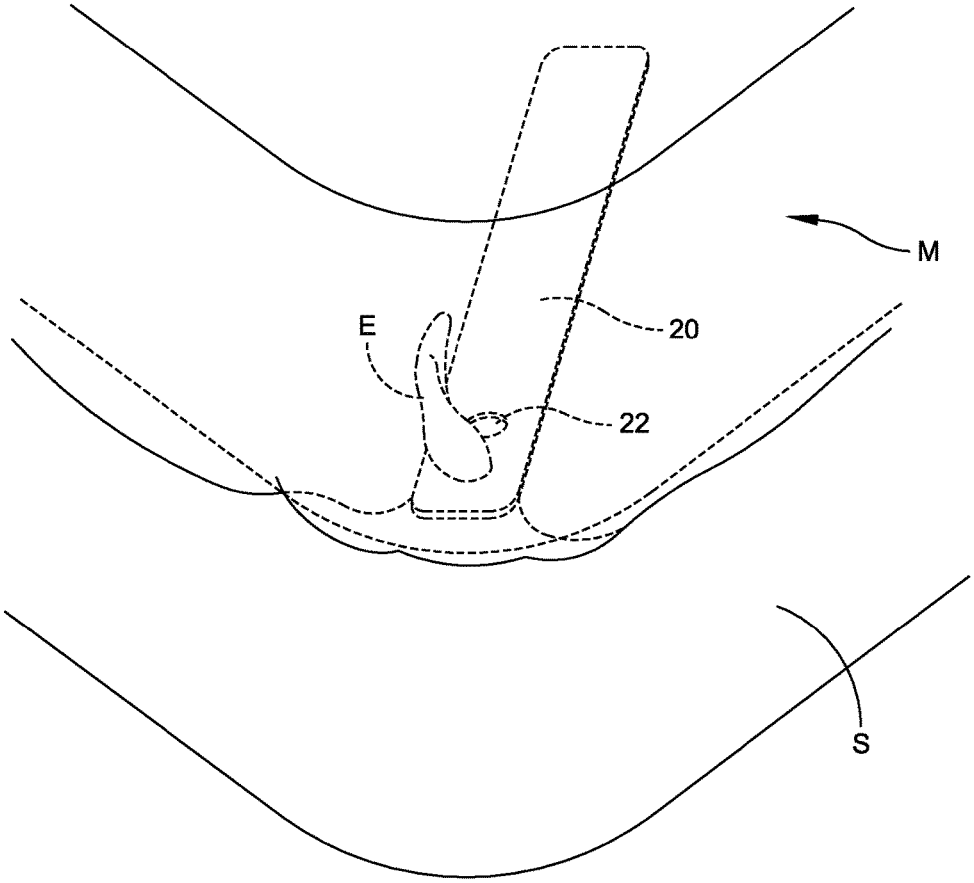
FIG. 15 is a fragmentary perspective view illustrating the final position of the holder.

With respect to the holder described in FIGS. 9-11, reference may now be made to the steps illustrated in order to secure the holder under the mattress. Thus, in FIG. 12 there is illustrated the holder 20 in position adjacent to the corner of the mattress. The holes 22 are illustrated pointing at the mattress. A corner E of the bedding is illustrated as being passed downwardly through the outer hole 22B. FIG. 13 then illustrates the corner E pulled downwardly so as to firmly engage with the outer hole 22B. In addition, one may pass the corner E back through the adjacent hole 22 illustrated in FIG. 13 as inner hole 22 A. In either case, FIG. 14 illustrates the holder 20 being rotated in the direction of the arrow D. Reference may now be made to FIG. 15 which shows the holder 20 in position, engaging the corner E of the sheet B and disposed between the mattress M and the box spring S.

Figure 12:
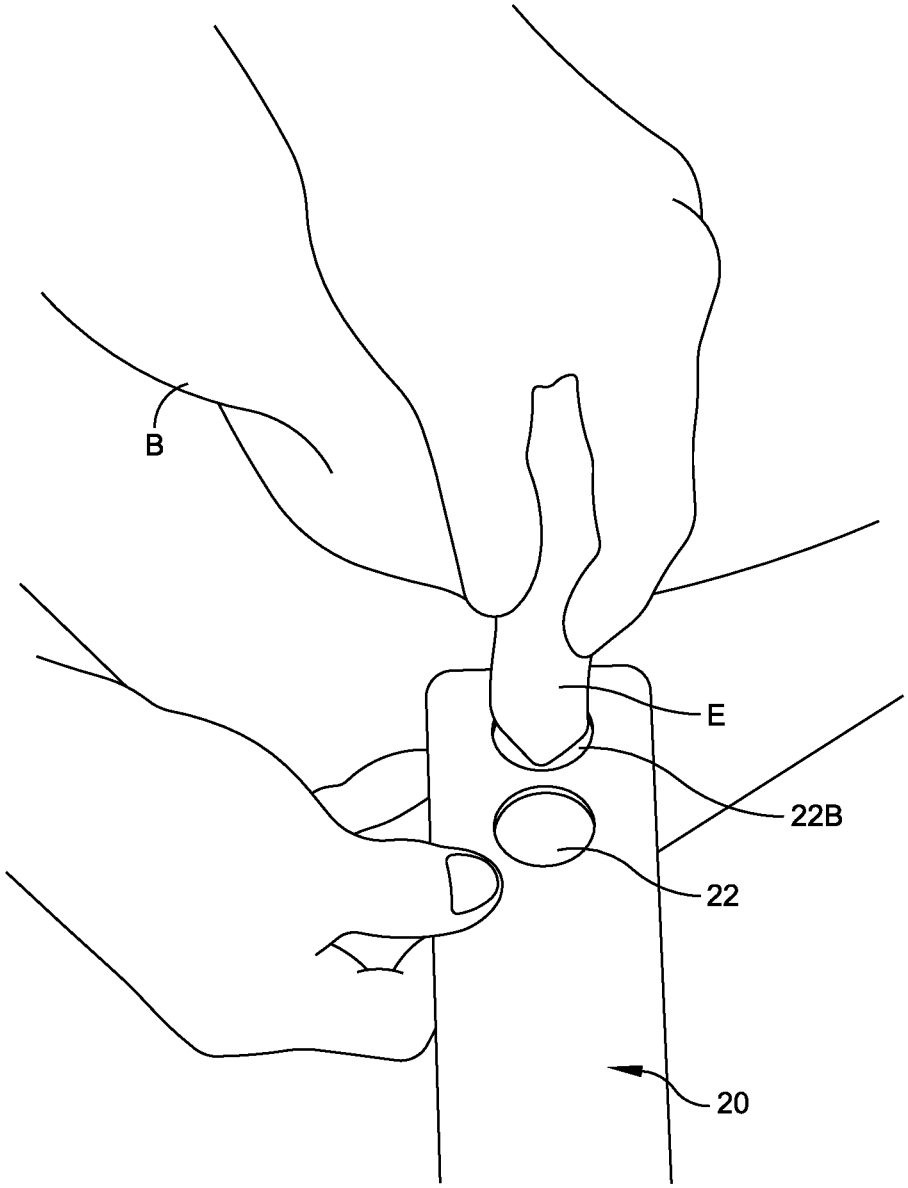
FIG. 12 illustrates the holder of FIG. 9 in a first position wherein a corner of the sheet is inserted from above into one of the holes of the holder.

In still another variation of the method of installation the user can start with the holder in a reversed position to that shown in FIG. 12 with the holed end facing outwardly. In other words the bed holder can be directly inserted under the mattress with the holes exposed. Then the corner E is inserted upwardly through on of the holes 22; or even up and down through the adjacent pair of holes. The bed holder is then further inserted between the mattress and box spring.

Figure 16:
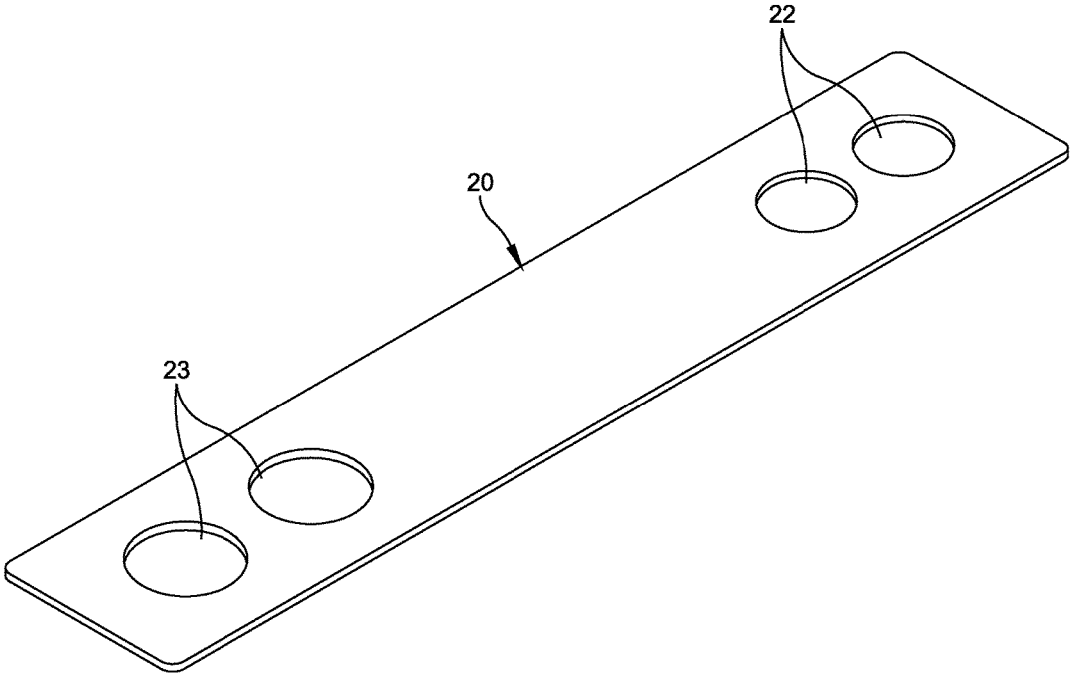
FIG. 16 is a perspective view of an alternate embodiment in which there are two pairs of securing holes of different diameter.

Reference is now made to the perspective view of FIG. 16 which shows a variation of the holder 20 illustrated in FIGS. 9-11. One of the important aspects of the present invention is the ability of the holder to engage with different bedding fabrics of different weight or texture. For this purpose, the holder 20 shown in FIG. 16 is provided with different hole arrangements. This includes a first pair of holes 22 at one end and a second pair of holes 23 at the opposed end. It is noted that the holes 23 are each of a larger diameter than the holes 22. In this way the holder can be used to accommodate different bedding materials. For example, a blanket or comforter is generally thicker in consistency and thus the engagement of corners of the blanket or comforter can engage with the larger hole or holes 23.

Figure 17:
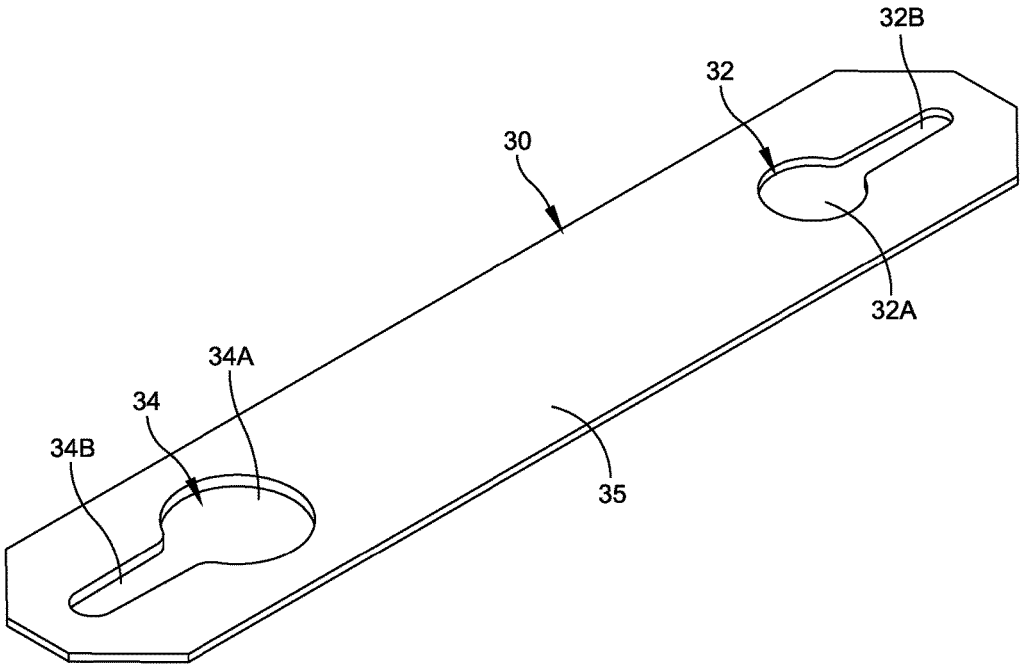
FIG. 17 is a perspective view showing one side of a third embodiment of the bedding holder of the present invention.
Figure 18:
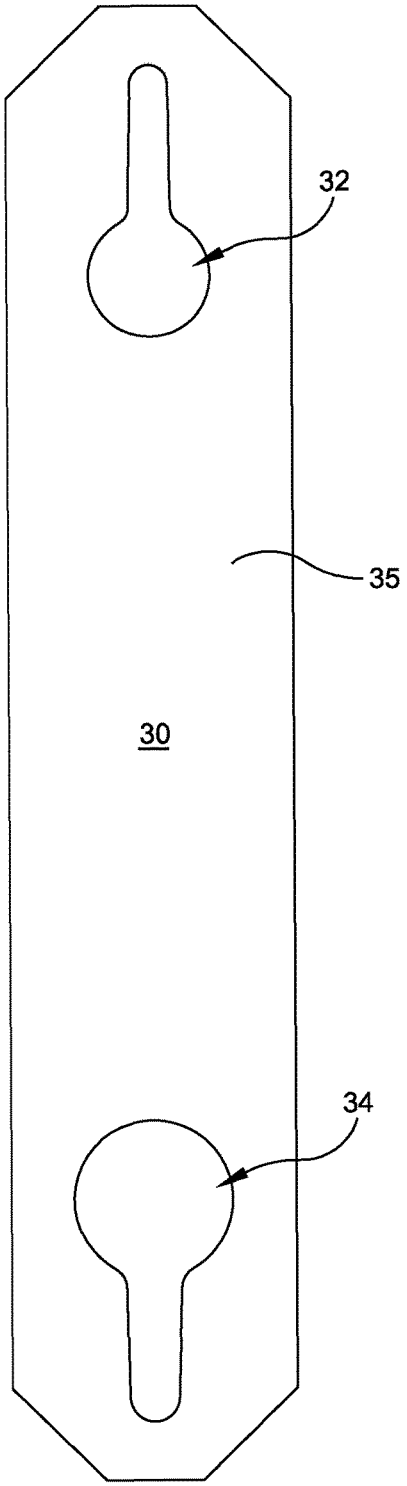
FIG. 18 is a plan view of one side of the bedding holder of FIG. 17.
Figure 19:
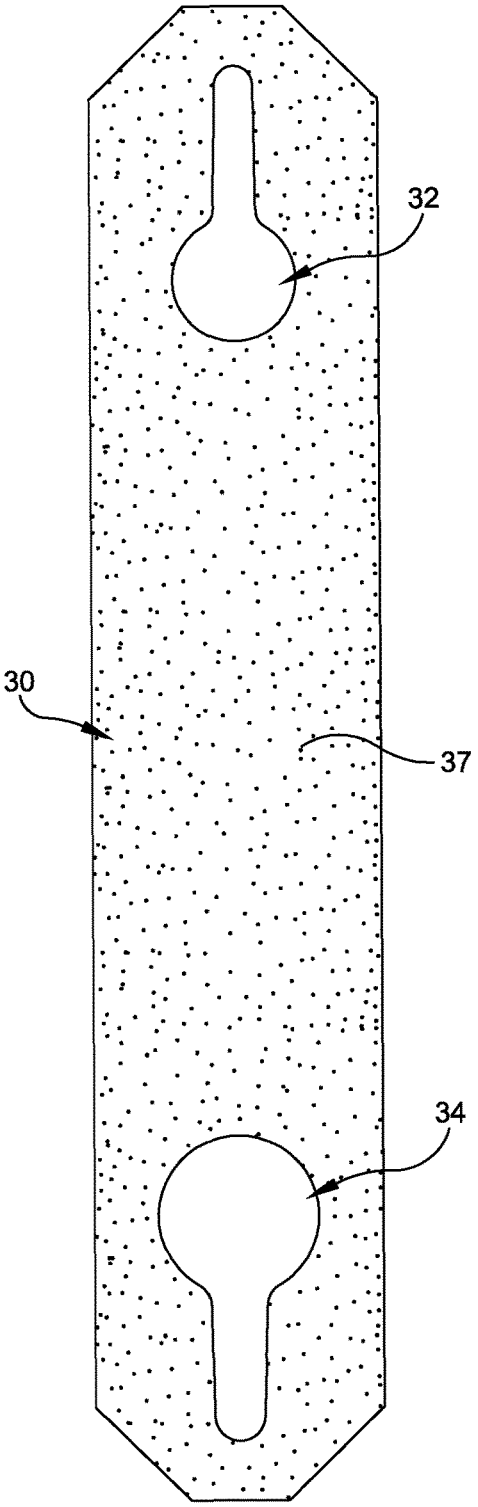
FIG. 19 is a plan view of the other side of the bedding holder of FIG. 18.

Reference is now made to still another embodiment of the present invention illustrated in FIGS. 17-19. This illustrates the holder 30 having opposed holes 32 and 34. The hole 32 includes a circular portion 32A and an elongated slot portion 32B. The hole 34 includes a circular portion 34A and an elongated slot portion 34B. As in the version illustrated in FIG. 16, the hole 34 is larger in size than the hole 32. FIG. 17 shows one side 35 of the holder and FIG. 19 shows the other side 37 of the holder.

Figure 20:
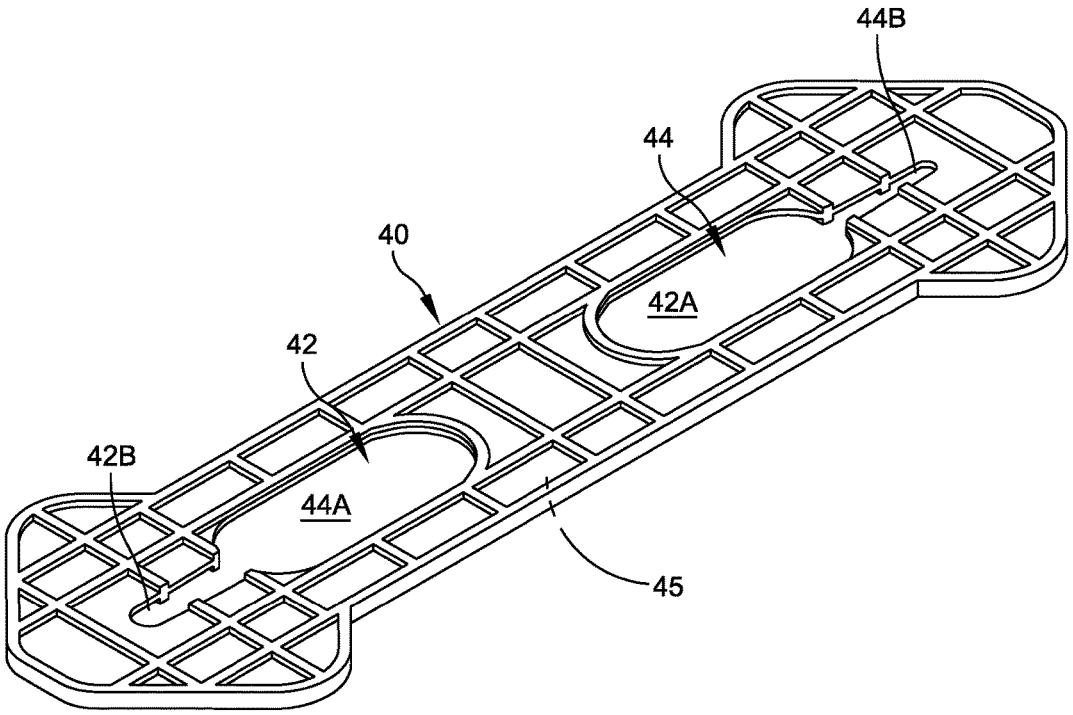
FIG. 20 is a perspective view showing one side of a fourth embodiment of the bedding holder of the present invention.
Figure 21:
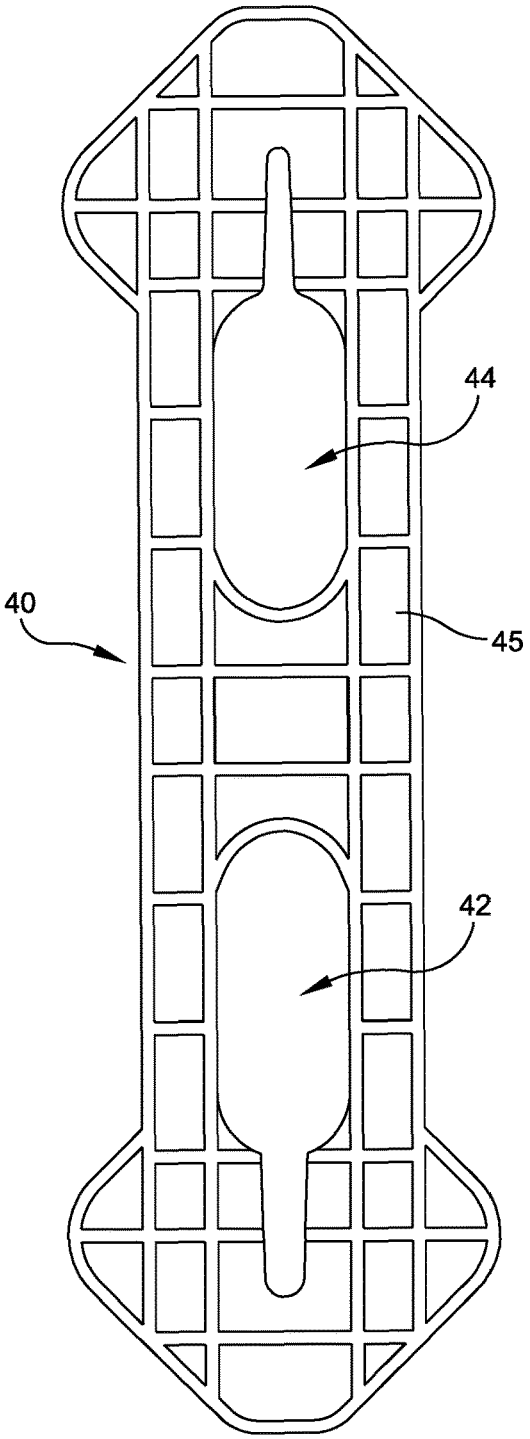
FIG. 21 is a plan view of one side of the bedding holder of FIG. 20.
Figure 21A:
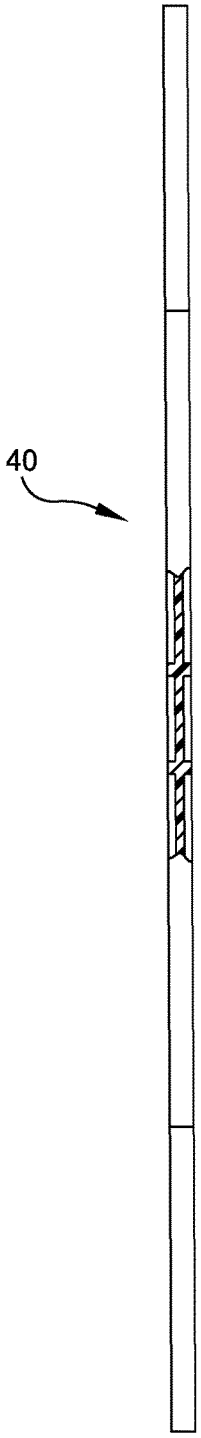
FIG. 21A is a side view of the embodiment shown in FIG. 21.
Figure 22:
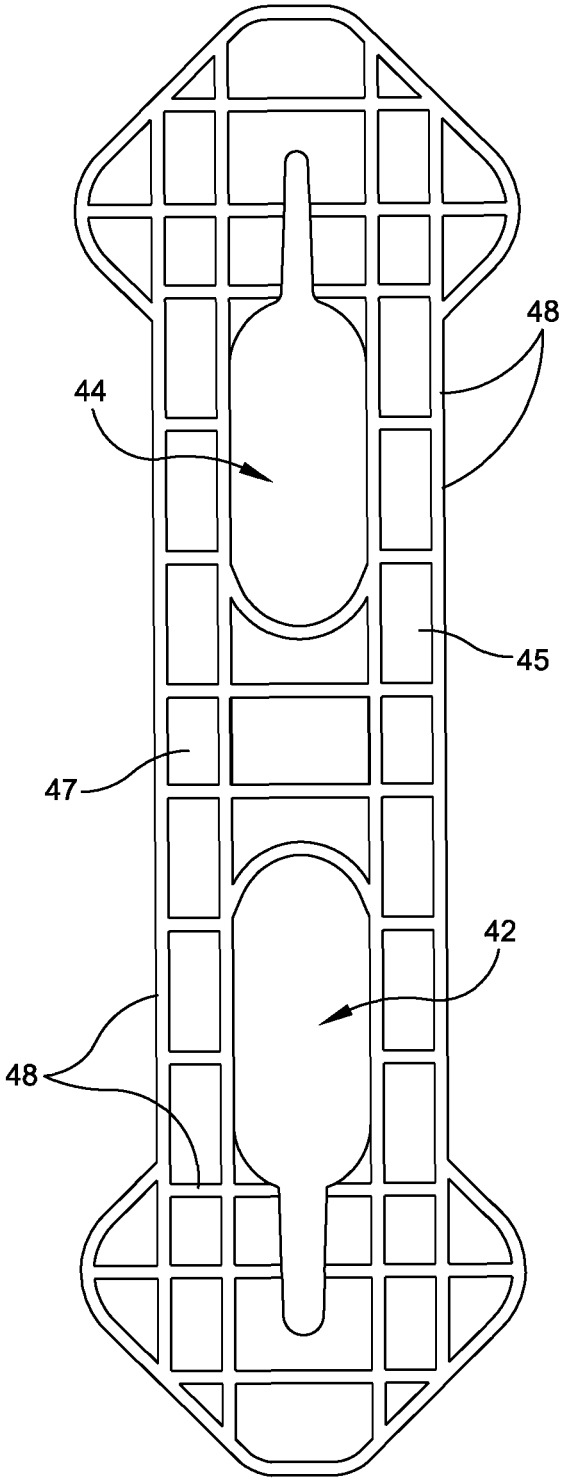
FIG. 22 is a plan view of the other side of the bedding holder of FIG. 21.

Reference is now made to still a further embodiment of the present invention illustrated in FIGS. 20-22. This embodiment illustrates a bed holder 40 that includes opposed end holes 42 and 44. The hole 42 is comprised of an oval portion 42A and an elongated slot portion 42B. Similarly, hole 44 is comprised of an oval portion 44A and an elongated slotted portion 44B. In both the embodiment of FIG. 17 as well the embodiment of FIG. 20, the circular or oval portions are contiguous with the slotted portions so that if a bedding material enters the circular or oval portion, it can then be wedged directly into the slotted portion. Also, in the embodiment of FIGS. 20-22 one of the holes 42, 44 may be made wider or even longer to accommodate heavier bedding material. In the embodiment of FIGS. 20-22 one side is shown at 45 and the opposite side, per FIG. 22, is shown at 47. It is noted that the side 47 is provided with a series of separate ribs 48 that are useful in providing a more rigid structure. Also the ribs assist in maintaining the bed holder under the mattress. The ribs are shown as separate segments but together from a continuous rib web.

In the embodiment depicted in FIGS. 20-22, it is noted that there are provided wider ends. This makes it easier to make sure that the sheet wraps around the end of the bed anchor. Also, protrusions can be provided on both sides of the holder basically in the form shown in FIG. 22. This same rib pattern can be provided on both sides of the holder. The ribs protrude approximately 1/16 inch from the planar surface on both sides of the holder.

Figure 23:
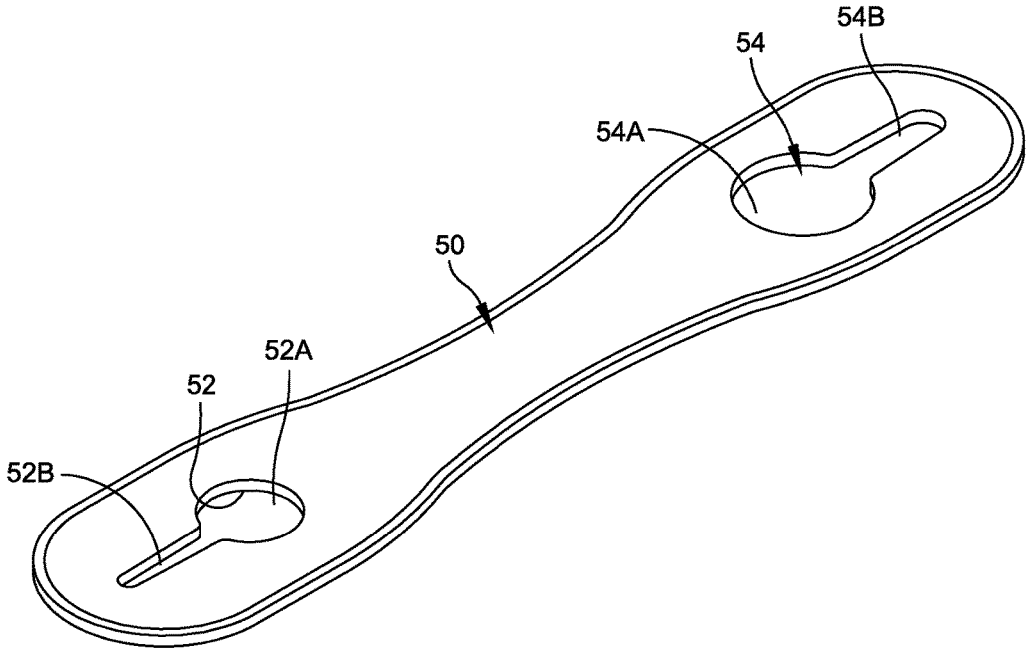
FIG. 23 is a perspective view showing one side of a fifth embodiment of the bedding holder of the present invention.
Figure 24:
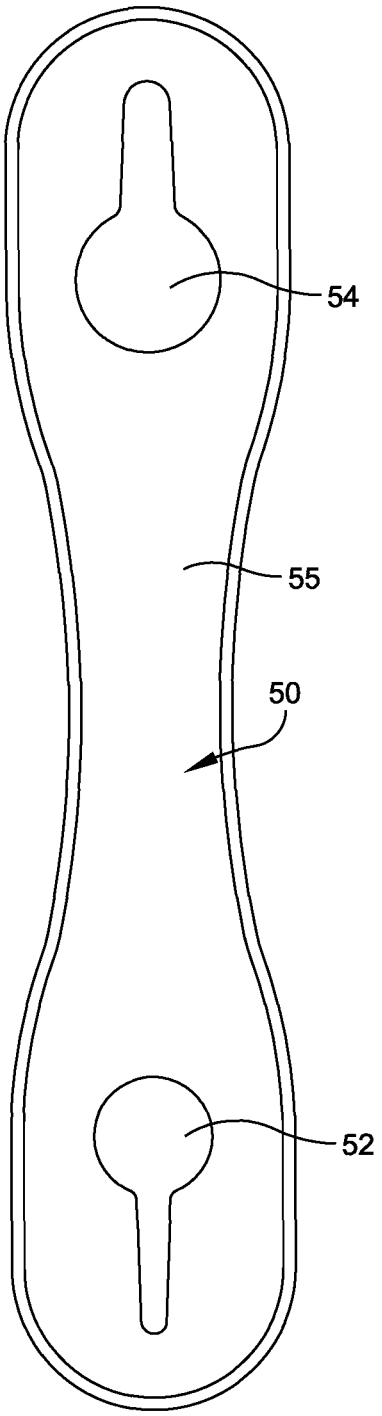
FIG. 24 is a plan view of one side of the bedding holder of FIG. 23, it being understood that the reverse side has substantially the same appearance and dimensions.

FIG. 23 is a perspective view showing one side of a fifth embodiment of the bedding holder of the present invention. FIG. 24 is a plan view of one side of the bedding holder of FIG. 23, it being understood that the reverse side has substantially the same appearance and dimensions. Reference is now made to still another embodiment of the present invention illustrated in FIGS. 23 and 24. This illustrates the holder 50 having opposed holes 52 and 54. The hole 52 includes a circular portion 52A and an elongated slot portion 52B. The hole 54 includes a circular portion 54A and an elongated slot portion 54B. As in the version illustrated in FIG. 16, the hole 54 is larger in size than the hole 52. FIG. 24 shows one side 55 of the holder. The other side of the holder can be identical in size and shape.

Figure 25:
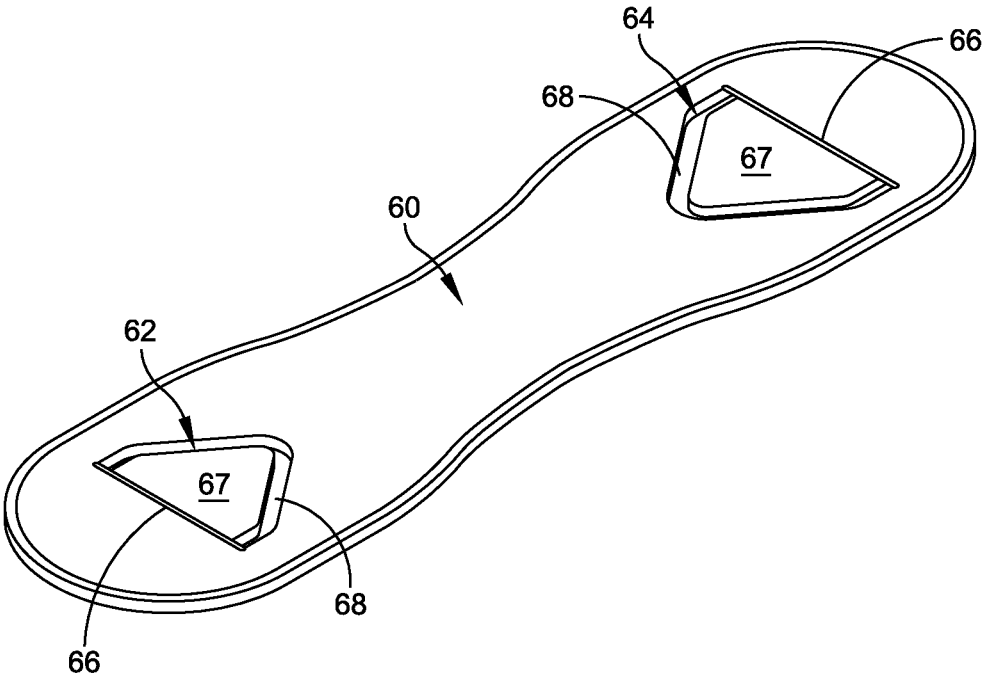
FIG. 25 is a perspective view showing one side of a sixth embodiment of the bedding holder of the present invention.
Figure 26:
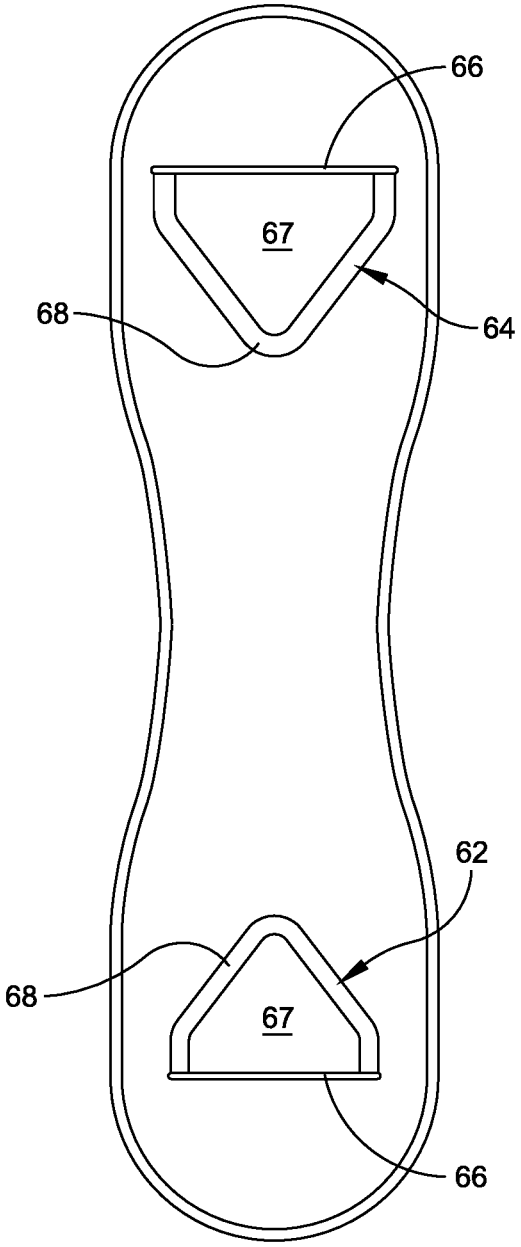
FIG. 26 is a plan view of one side of the bedding holder of FIG. 25, it being understood that the reverse side has substantially the same appearance and dimensions.

FIG. 25 is a perspective view showing one side of a sixth embodiment of the bedding holder of the present invention. FIG. 26 is a plan view of one side of the bedding holder of FIG. 25, it being understood that the reverse side has substantially the same appearance, shape and dimensions. Reference is now made to the embodiment of the present invention illustrated in FIGS. 25 and 26. This illustrates the holder 60 having opposed holes 62 and 64. The hole 62 may be described as somewhat triangular in shape. The hole 64 may also be described as somewhat triangular in shape. As in earlier versions of the present invention the hole 64 is larger in size than the hole 62. FIG. 26 shows one side 55 of the holder. The other side of the holder can be identical in size and shape.

In the embodiment of FIGS. 25 and 26, rather than having a totally open hole, one side of the hole is provided with a living hinge 66; the living hinge at the hole 64 being longer than the living hinge at the hole 62. Each living hinge 66 supports a hinge piece 67, that in its rest position is co-planar with the general plane of the holder itself. Each hinge piece 67 is formed to substantially the same shape as the corresponding hole 62. This leaves a narrow space 68 that extends about the entire edge of the hinge piece outside of the living hinge itself. When a corner of the bedding material is inserted against the hinge piece the hinge piece deflects against the bias provided by the living hinge, and the user can then pull the bedding material through the space 68 (which will be opened). This action essentially locks the bedding material relative to the holder hinge and thus maintains a secure retaining of the bedding material relative to the bedding holder. The embodiment shown in FIGS. 25 and 26 can be used in any one of a number of different methods of installation described herein whether the bedding material is forced upwardly or downwardly through the hinge or regardless of the positioning of the holder relative to the mattress.

Having now described a limited number of embodiments of the present invention, it should now be apparent to those skilled in the art that numerous other embodiments and modifications thereof are contemplated as falling within the scope of the present invention, as defined by the appended claims. Although the principles of the present invention have been described in association with a limited number of embodiments described herein it should be understood that the principles also apply to many other embodiments.

What is claimed is:

1. A bedding anchor that is comprised of a single holder that has at least one open through port for receiving an edge of a bedding fabric therethrough, said single holder being elongated in shape, having a length greater than a width thereof, and having the one open port arranged closer to one end of opposed one and other ends of the single holder so that, when the single holder is flipped lengthwise, the single holder can be inserted under an overlying supporting mattress wherein the at least one open through port has a living hinge for support of a hinged piece.

2. The bedding anchor of claim 1 wherein the single holder is substantially planar having one and other opposed flat surfaces.

3. The bedding anchor of claim 2 wherein the elongated holder has a length that is at least three times the width of the elongated holder.

4. The bedding anchor of claim 3 wherein the single holder has a pair of spaced apart open through ports for receiving the bedding fabric.

5. The bedding anchor of claim 3 wherein the open through port has an enlarged portion that is contiguous with a slotted portion.

6. The bedding anchor of claim 1 wherein the single holder is substantially planar having one and other opposed flat surfaces that are of different visual characteristics.

7. The bedding anchor of claim 1 wherein the single holder has a pair of open through ports disposed respectively at the one and other ends of the single holder.

8. The bedding anchor of claim 7 wherein one of the pair of open through ports is larger in area than the other of the pair of open through ports.

9. The bedding anchor of claim 8 wherein the pair of open through ports are separated from each other with one of the open through ports being closer to the one end of the holder and the other open through port being closer to the other end of the holder.

10. The bedding anchor of claim 9 wherein each open through port has an enlarged portion that is contiguous with a slotted portion.

11. The bedding anchor of claim 10 wherein at least the slotted portions of respective open through ports are of different width.

12. A bedding anchor that is comprised of a holder that has at least one open through port for receiving an edge of a bedding fabric therethrough, said holder being elongated in shape, having a length greater than a width thereof, and having the one open port arranged closer to one end of opposed one and other ends of the holder so that, when the holder is rotated, the holder can be inserted under an overlying supporting mattress, the holder being substantially planar having one and other opposed flat surfaces, the at least one open through port comprising a pair of spaced apart open through ports for receiving the bedding fabric, each of the pair of spaced apart open through ports being of substantially the same open surface area.

13. The bedding anchor of claim 12 wherein the pair of spaced apart open through ports have a separation distance that is less than a diameter of either of the pair of spaced apart open through ports and each of the pair of spaced apart open through ports are also of substantially the same open shape.

14. The bedding anchor of claim 13 wherein there are provided a pair of open through ports disposed respectively at both ends of the holder.

15. A method of using a bedding anchor for securing corners of a bedding fabric relative to a mattress over which the bedding fabric is to be secured including providing a holder that has at least one open through port for receiving an edge of a bedding fabric therethrough, said holder being elongated in shape, having a length greater than a width thereof, and having the one open port arranged closer to one end of opposed one and other ends of the holder, inserting the bedding fabric through the open through port so that the bedding fabric interlocks with the open through port, pivoting the holder lengthwise and inserting the pivoted holder under the overlying mattress.

16. The method of claim 15 wherein the open through port has an enlarged portion that is contiguous with a slotted portion and the step of inserting includes inserting first through the enlarged portion and subsequently moving the bedding fabric into the slotted portion.

17. The method of claim 15 wherein the holder includes a pair of open through ports disposed respectively at the one and other ends of the holder.

18. The method of claim 17 wherein one of the pair of open through ports is larger in area than the other of the pair of open through ports.

19. The method of claim 18 wherein the open through ports are comprised of one of a set of two open through ports, a single open through port having an enlarged portion that is contiguous with a slotted portion and an open through port having a living hinge.

20. The method of claim 15 wherein the holder includes at least a first through port disposed adjacent the one end of the holder, and at least a second through port disposed adjacent the other end of the holder, said at least one first through port being larger in open area than the at least one second port.

21. The method of claim 15 wherein the bedding fabric can be initially inserted either downwardly or upwardly relative to the holder open through port.

* * * * *